United States Patent [19]

Rathbun

[11] 4,251,721

[45] Feb. 17, 1981

[54] PATTERN AND THRESHOLD SPEED CALCULATOR

[76] Inventor: Charles D. Rathbun, 1005 Mistletoe, Ft. Worth, Tex. 76126

[21] Appl. No.: 66,357

[22] Filed: Aug. 14, 1979

[51] Int. Cl.[3] ..... G06C 27/00; G06C 3/00

[52] U.S. Cl. ..... 235/78 R; 235/78 N; 235/88 N

[58] Field of Search .... 235/61 NV, 70 A, 77–78 RC, 235/85 R, 88 R–88 RC

[56] References Cited

U.S. PATENT DOCUMENTS

| | | | |
|---|---|---|---|
| 2,076,242 | 4/1937 | Marquis | 235/88 RC |
| 2,943,789 | 7/1960 | Parigini | 235/88 F |
| 2,996,242 | 8/1961 | Bannister . | |
| 3,010,650 | 11/1961 | Aubert | 235/88 RC |
| 3,929,279 | 12/1975 | Dibley . | |
| 4,011,987 | 3/1977 | Cheek . | |
| 4,134,006 | 1/1979 | Gordon | 235/78 N |

*Primary Examiner*—L. T. Hix
*Assistant Examiner*—Benjamin R. Fuller
*Attorney, Agent, or Firm*—Donald J. Singer; Arsen Tashjian

[57] ABSTRACT

A circular disk type calculator for determining the proper approach speed for a particular aircraft within a specified range of gross weights and flap settings. The calculator includes three superposed circular disks pivoted for independent rotation about their centers. A third lower disk is imprinted with appropriate speed and weight information. A second intermediate disk includes cut-outs and windows to expose certain readings on the lower disk and also includes a flap setting marker extending outwardly from its outer edge. A first upper disk is provided with appropriate windows and markings relating to the other disks thereby indicating the desired information including pattern and threshold air speed for the gross weight and flap setting of the aircraft.

3 Claims, 4 Drawing Figures

FIG. 1
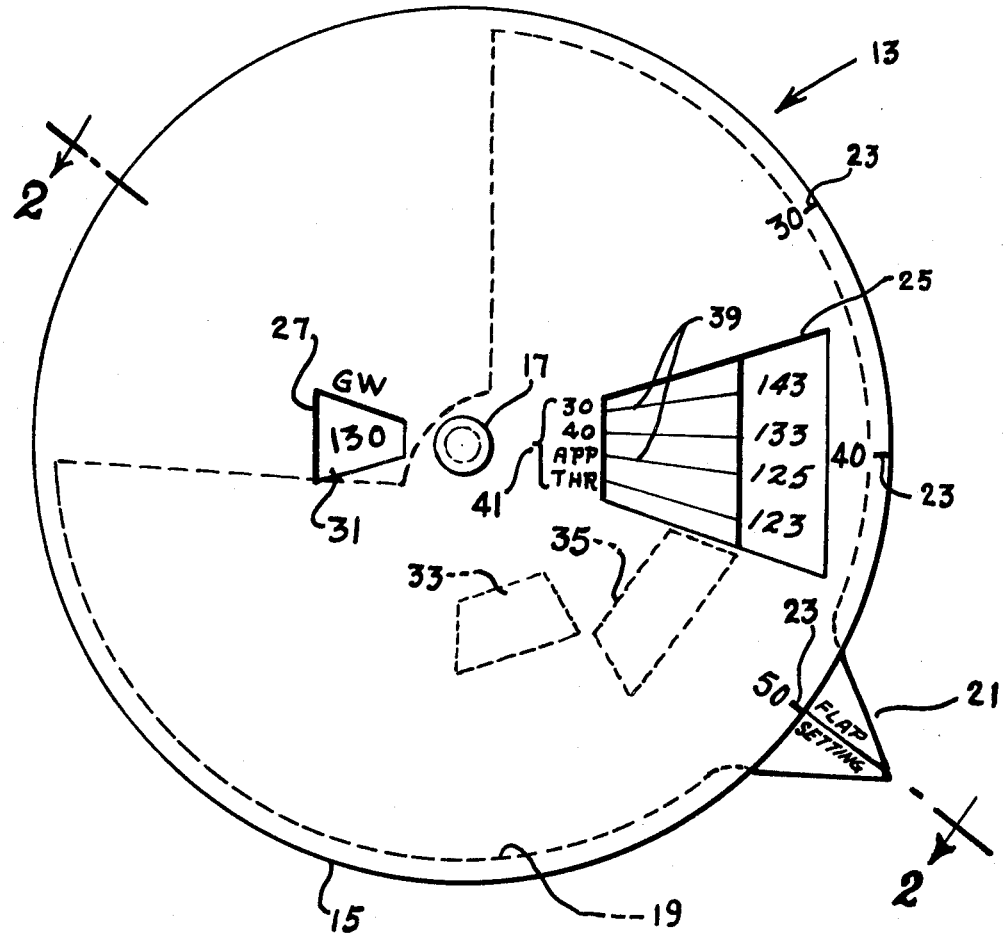
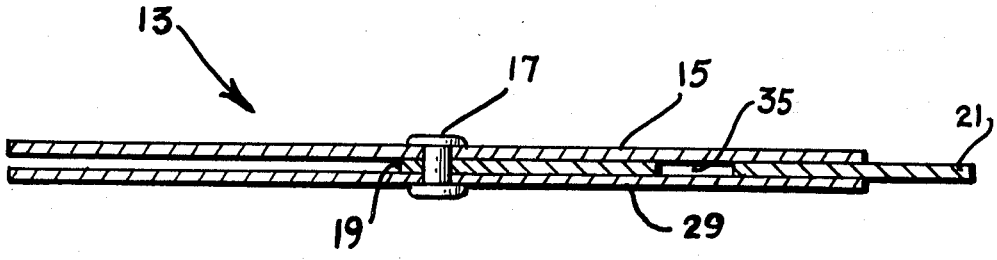
FIG. 2

PATTERN AND THRESHOLD SPEED CALCULATOR

STATEMENT OF GOVERNMENT INTEREST

The invention described herein may be manufactured and used by or for the Government for governmental purposes without the payment of any royalty thereon.

BACKGROUND OF THE INVENTION

This invention relates to a spin wheel calculator for pattern and threshold speeds for a particular aircraft and, more particularly, the invention is concerned with providing an in-flight calculator which will permit the pilot, copilot and/or crewmembers to quickly and safely determine the proper pattern, approach and threshold speeds for a particular aircraft, such as the KC-135, by setting the calculator for the appropriate gross weight and flap setting and taking the proper reading through the speed window.

Heretofore, it has been common practice to provide the pilot of each particular aircraft with all of the critical data required for determining the approach, pattern and threshold speeds of his aircraft. This data is usually in the form of booklets and tables available for each aircraft which are normally incorporated in the operational manual of the aircraft. In order to work out the critical landing information, the pilot is generally required to utilize the operational manual along with one or more computers. It is easy to see that there would be many chances for human error where the pilot must refer to various curves and tables in order to coordinate the information.

It can be seen that it would be most desirable to provide a single instrument with which the pilot would be able to coordinate all of the necessary information without reference to any additional charts and/or tables. During the landing of the aircraft, the time involved in obtaining and coordinating information is critical and the necessary data should be instantaneously available to the pilot in command. Also, the information should be readily available from a source which can be easily carried by the pilot.

The hereinafter described pattern and threshold speed calculator will provide all of the desired features noted above. The speed and accuracy with which the pilot is able to make the various determinations using the subject calculator, will add greatly to the safety of the operation of the aircraft as well as to the safety of all air traffic in the vicinity because the pilot can give his undivided attention to conditions around the airport after the proper pattern and threshold speeds have been quickly calculated. Also, the subject calculator provides the pilot with landing information which the pilot needs based upon the weight of any particular aircraft and permits the determination of the proper approach, pattern and threshold speeds for the aircraft.

SUMMARY OF THE INVENTION

The present invention is concerned with providing a pattern and threshold speed calculator suitable for use by the pilot-copilot and crew members to shorten the time needed to determine speeds during transition thereby allowing the crew more time to clear outside the aircraft during this critical phase of flight. The calculator includes three substantially circular plates riveted together at the center. By placing the aircraft gross weight in the appropriate window and moving the flap setting marker to the appropriate flap setting for the approach, the pattern and threshold speeds will be visible in the speed window.

Accordingly, it is an object of the invention to provide a pattern and threshold speed calculator which will provide the pilot with an instantaneous determination of the proper approach, pattern and threshold speeds for a particular aircraft having a specific gross weight and appropriate flap setting.

Another object of the invention is to provide a flight data calculator for determining the approach, pattern and threshold speeds which is extremely simple to operate even by relatively inexperienced crew members with the possibility of errors being reduced to a minimum.

Still another object of the invention is to provide a pattern and threshold speed calculator which completely eliminates the need for performing mental calculations based on figures found in tables in order to determine the proper speeds during landing.

A further object of the invention is to provide a calculator which is simple and inexpensive to make from readily available materials and yet will accurately indicate the proper pattern and threshold speeds for a particular aircraft having a specific gross weight.

These and other objects, features and advantages will become more apparent after considering the following detailed description taken in conjunction with the annexed drawings and appended claims.

BRIEF DESCRIPTION OF THE DRAWINGS

FIG. 1 is a plan view of the pattern and threshold speed calculator according to the invention suitable for use with the KC-135 aircraft;

FIG. 2 is a cross-sectional view of the calculator of FIG. 1 taken along the line 2—2;

DESCRIPTION OF A PREFERRED EMBODIMENT

Figure 3:
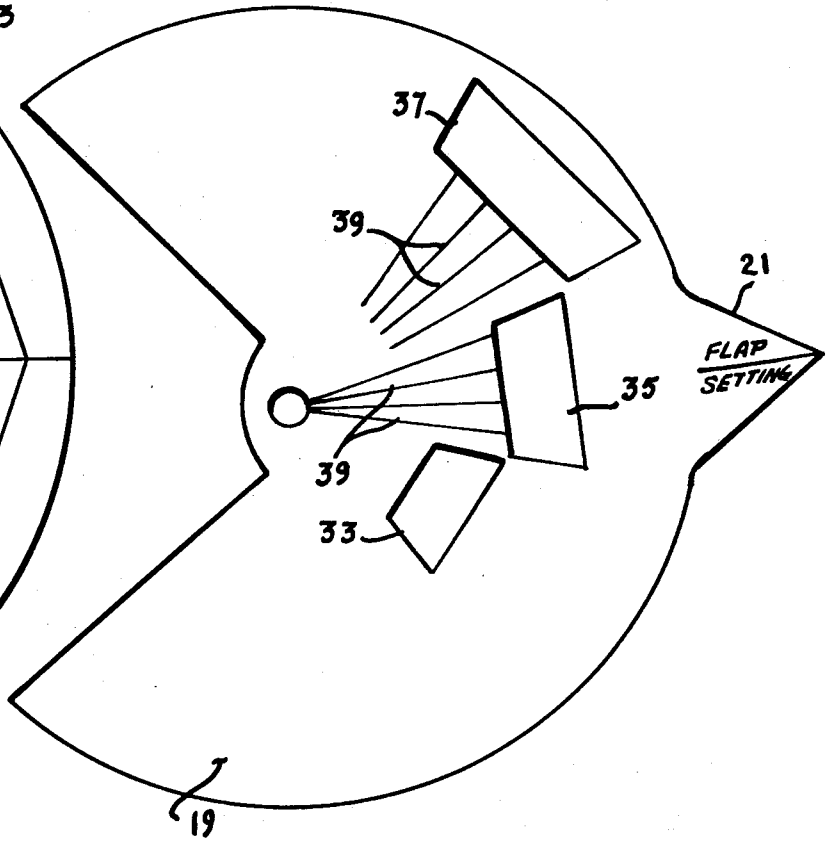
FIG. 3 is a plan view of the second intermediate disk of the calculator showing the cut-outs and the flap setting marker.

Referring now to the drawings in which like reference numerals refer to like elements throughout, FIG. 1 shows a plan view of the calculator 13 which includes a first upper disk 15 rotatably mounted on a central pin member 17. A second intermediate disk 19 (shown in FIG. 3) is also rotatably mounted on the central pin member 17 for movement therearound independent of the movement of the first upper disk 15. A flap setting marker 21 extends outwardly from the outer edge of the intermediate disk 19. The marker 21 is used to align the flap setting members 23 marked on the upper disk 15 with the intermediate disk 19 position. The upper disk 15 is also provided with a four-sided trapezoidal shaped opening 25 which aligns with three separate trapezoidal shaped cut-outs in the intermediate disk 19. Another opening 27 is located in the upper disk 15 through which the gross weight of the aircraft can be set.

Figure 4:
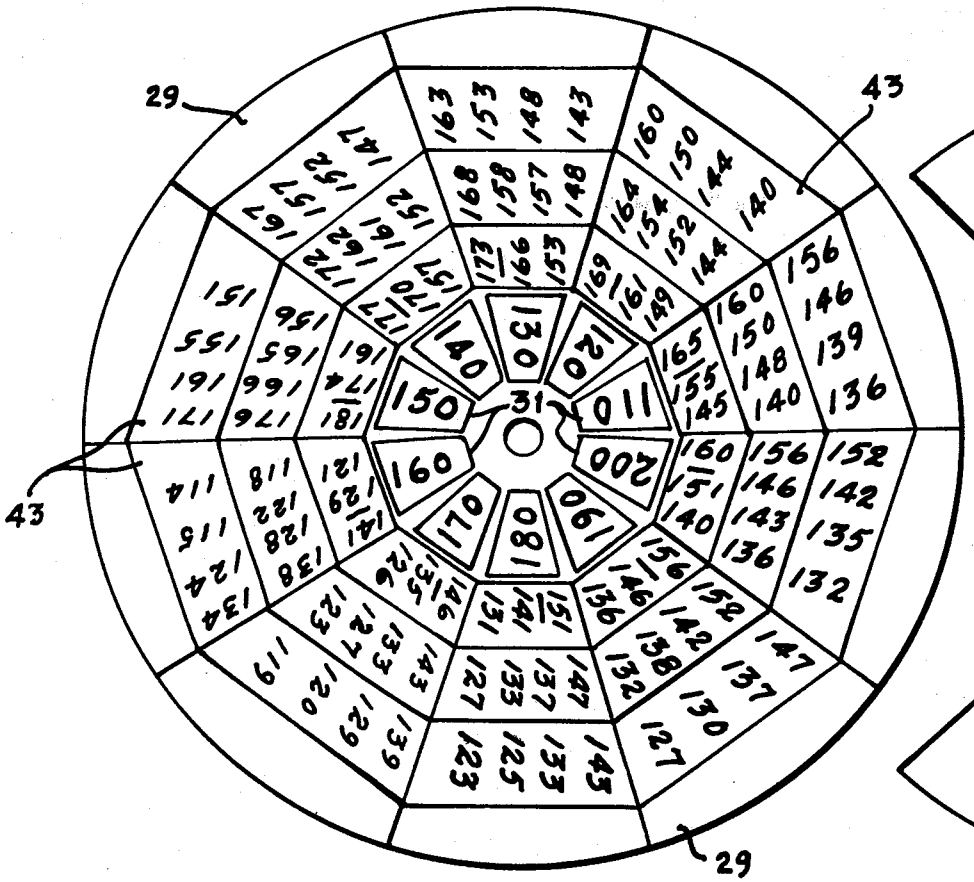
FIG. 4 is a plan view of the third lower disk of the calculator showing the speed and gross weight markings on the surface thereof.

A third lower disk 29 (shown in FIG. 4) is also rotatably mounted on the central pin member 17 for independent movement relative to the other disks. A series of gross weight markings 31 from 110 to 200 are located near the central area of the disk 29 and are visible through the opening 27 in the upper disk 15. Three sets of speed readings for each gross weight marking cover the remainder of the disk 29 for visibility through the opening 25 with only one set of speed readings being visible at each flap setting.

The intermediate disk 19 is provided with three separate cut-outs, each spaced radially outward from the central pin member 17 at differnt distances and at different angular positions. The first cut-out 33 corresponds to the flap setting 30 and aligns with the inner portion of the opening 25 in the upper disk 15 when the flap setting marker 21 is set at 30. The second cut-out 35 corresponds to the flap setting 40 and aligns with the center portion of the opening 25 in the upper disk 15 when the flap setting marker is set at 40. The third cut-out 37 corresponds to the flap setting 50 and aligns with the outer portion of the opening 25 in the upper disk 15 when the flap setting is set at 50. A series of radial lines 39 are drawn on the disk 19 between the second and third cut-outs 35 and 37 and the inner edge of the opening 25 which is provided with pattern, approach and threshold markings 41 so that the eye can easily follow along and obtain the proper reading. The cut-outs 33, 35 and 37 are trapezoidal shaped and are configurated such that the total area of the three cut-outs 33, 35 and 37 is substantially equal to the total area of the trapezoidal shaped opening 25 in disk 15. A 90° angular section of the disk 19 is cut away so that the gross weight markings 31 on the disk 29 are visible through the opening 27 in the disk 15. The pattern, approach and threshold speeds 43 marked on the lower disk 29 are visible through one of the cut-outs 33, 35 or 37 in the disk 19 and the opening 25 in the disk 15.

In operation, to determine the proper pattern, approach and threshold speeds for a given aircraft such as, for example, a KC-135, at a given gross weight and flap setting, the flap setting marker 21 on the intermediate disk 19 is set in alignment with a flap setting member 23 on the upper disk 15. In the example shown in FIG. 1, the flap setting is 50. The lower disk 29 is then rotated until the proper gross weight figure 31 appears in the opening 27 in the disk 15. In the example of FIG. 1, the gross weight of the aircraft is 130. The proper pattern, approach and threshold speeds 43 then will become visible when the cut-out 37 in the intermediate disk 19 aligns with the four-sided trapezoidal shaped opening 25 in the upper disk 15. By following along the lines 39 from the markings 41, the pattern, approach and threshold speeds of 143, 133, 125 and 123 can be read off the calculator.

Thus, it can be seen that the hereinbefore described calculator can be used by aircraft crewmembers to compute speeds during transition and pattern work and, since the amount of time needed to determine the appropriate speeds is decreased, more time is allowed for clearing for other aircraft. Also, while the present calculator is shown for use with the KC-135 aircraft, it is suitable for use with most all aircraft both smaller and larger than the KC-135. The invention is independent of the particular aircraft employed since it is directed to the placing of various indicia and various shaped openings in specific positions on the disks so that the required data can be easily determined and displayed.

Although the invention has been illustrated in the foregoing specification in terms of a preferred embodiment thereof, the invention is not limited to this embodiment or to the particular configuration shown and described. It will be apparent to those skilled in the art that certain changes, modifications and substitutions can be made with respect to the configuration of the elements without departing from the true spirit and scope of the appended claims. It can be seen that the invention can be used to quickly determine the speed during transition, and thereby reduce the potential of a mid-air collison during this critical phase of flight.

Having thus described the nature of my invention, what I claim and desire to secure by Letters Patent of the United States is:

1. A calculator for use in determining the pattern, approach and threshold speeds of an aircraft during the transition and landing phase, said calculator comprising a central pin member, a first upper disk of substantially circular configuration having two trapezoidal shaped openings therein, one of said trapezoidal shaped openings for indicating speed of the aircraft and the other for indicating gross weight, said first disk being independently rotatable around said pin member, a second intermediate disk immediately under said first disk and independently rotatable around said pin member, said second disk being circular in configuration with a 90° angular section removed and having three trapezoidal shaped cut-outs each spaced radially outward at increasing distances from the center and at adjacent positions, a third lower disk immediately below said second disk and independently rotatable around said pin member, said third disk having markings thereon corresponding to gross weight and speed of the aircraft, and means for determining the effect of the flap setting of the aircraft on the pattern, approach and threshold speeds of the aircraft at any one of a series of gross weight conditions.

2. The calculator for determining pattern, approach and threshold speeds defined in claim 1 wherein said means for determining the effect of the flap setting of the aircraft includes a flap setting marker extending outwardly from the outer edge of said second intermediate disk for alignment with flap setting markings on the outer edge of said first upper disk.

3. The calculator for determining pattern, approach and threshold speeds defined in claim 2 wherein one of said three trapezoidal shaped cut-outs in said second intermediate disk is in alignment with the speed indicating trapezoidal shaped opening in said first upper disk when the flap setting marker is aligned with one of three corresponding flap setting markings on said first disk such that the correct speed markings on said third lower disk become visible.

* * * * *